US010029135B1

(12) United States Patent
Sharp

(10) Patent No.: US 10,029,135 B1
(45) Date of Patent: Jul. 24, 2018

(54) STRETCHING DEVICE

(71) Applicant: Tucker Sharp, Costa Mesa, CA (US)

(72) Inventor: Tucker Sharp, Costa Mesa, CA (US)

( * ) Notice: Subject to any disclaimer, the term of this patent is extended or adjusted under 35 U.S.C. 154(b) by 0 days.

(21) Appl. No.: 15/272,845

(22) Filed: Sep. 22, 2016

(51) Int. Cl.
*A63B 21/002* (2006.01)
*A63B 21/00* (2006.01)
*A63B 23/04* (2006.01)
*A63B 23/00* (2006.01)

(52) U.S. Cl.
CPC ..... *A63B 21/00047* (2013.01); *A63B 23/04* (2013.01); *A63B 2023/006* (2013.01)

(58) Field of Classification Search
CPC ..... A61H 1/02; A61H 1/0237–1/0244; A61H 1/0255; A61H 1/0259; A61H 2001/0248; A61H 1/0251; A61H 1/027; A63B 21/00047; A63B 23/04; A63B 2023/006; A63B 1/00; A63B 3/00; A63B 23/0405; A63B 23/0482; A63B 23/0488; A63B 23/0494; A63B 22/20; A63B 22/201; A63B 22/203
See application file for complete search history.

(56) References Cited

U.S. PATENT DOCUMENTS 2,690,789 A * 10/1954 Zadrozny ..... A61H 3/00 482/42
3,534,955 A * 10/1970 Wieland ..... A63B 3/00 482/42
3,896,798 A * 7/1975 Simon ..... A61H 1/0229 482/41
4,415,150 A * 11/1983 Iezza ..... A63B 3/00 211/182
4,629,180 A * 12/1986 Kaya ..... A63B 23/0211 482/140
6,699,162 B2 * 3/2004 Chen ..... A63B 21/4015 482/140
7,108,645 B2 9/2006 Lincoln
D613,804 S * 4/2010 Perez ..... D21/691
8,216,114 B1 7/2012 Wynn, III
9,259,604 B2 2/2016 Miller, Jr.
2003/0176262 A1 * 9/2003 Bussell ..... A63B 21/0083 482/112
2008/0182730 A1 * 7/2008 Conley ..... A61H 1/0244 482/95
2010/0063429 A1 * 3/2010 McClorey ..... A61H 15/00 601/122
2010/0323860 A1 12/2010 Reed
2013/0035217 A1 * 2/2013 Beck ..... A63B 23/04 482/79
2013/0110013 A1 5/2013 Carlson et al.
2015/0148205 A1 5/2015 Fides

* cited by examiner

*Primary Examiner* — Gregory Winter
(74) *Attorney, Agent, or Firm* — Eric Karich; Karich & Associates

(57) ABSTRACT

A stretching device has a pair of elongate stretching bars, a support frame, and an adjustment mechanism. Each of the elongate stretching bars includes a main body that extends from a front end to a rear end. The support frame supports each of the elongate stretching bars above the ground in a side-by-side orientation. The adjustment mechanism provides for adjusting the position of the front ends of the pair of elongate stretching bars, both horizontally and vertically, with respect to the support frame.

9 Claims, 6 Drawing Sheets

STRETCHING DEVICE

BACKGROUND OF THE INVENTION

Field of the Invention

This invention relates generally to stretching devices, and more particularly to a stretching device for facilitating a range of stretching and exercise activities.

Description of Related Art

The prior art teaches a range of devices for performing stretching and exercise activities.

For example, Reed, U.S. 2010/0323860, teaches a system for increasing flexibility and/or stretching that includes a user support set atop an enclosure. The enclosure houses mechanisms to actuate a cable system. Footholds support the feet from a user, wherein the cable system actuates between the footholds, and wherein the footholds actuate in at least a lateral motion to further accentuate increasing flexibility and/or stretching the muscles. A control handle is coupled to the cable system for the user to grasp, wherein the cable system actuates to either one of increase and release a tension to the grasped control handle, and wherein the control handle comprises at least one control to regulate the either one of increase and release the tension.

Lincoln, U.S. Pat. No. 7,108,645, teaches a stretching apparatus that includes a seat on top of a support frame and leg support wings which extend from opposite sides of the seat and move outward and upward away from the support frame as a handle at the top of the base is rotated. The handle attaches to a rotating mechanism which has struts extending from opposite sides that attach to the side of the leg support wings. The stretching apparatus is used to stretch the muscles of the lower and upper body including the legs, lower back and upper body. Stretch straps are provided on the side of the leg support wings to assist the user in a stretching exercise.

Carlson, U.S. 20130110013, teaches a device for rehabilitating a knee after knee surgery. The device includes a support adapted to support the leg at the popliteal fossa while allowing the knee to be bent about the support with little interference from the support. A method of knee rehabilitation includes the step of supporting the patient's leg on the support and allowing the patient to control to movement in order to overcome muscle guarding. The support is carried by uprights that are spaced apart far enough to allow the patient to be positioned on his back between the uprights with the knee to be rehabilitated disposed over the support and the other leg stretched straight under the support.

The prior art teaches various general forms of stretching device. However, the prior art does not teach a stretching device that includes the features described and claimed below. The present invention fulfills these needs and provides further advantages as described in the following summary.

SUMMARY OF THE INVENTION

The present invention teaches certain benefits in construction and use which give rise to the objectives described below.

The present invention provides a stretching device comprising a pair of elongate stretching bars, each having a main body that extends from a front end to a rear end; a support frame for supporting each of the elongate stretching bars above the ground in a side-by-side orientation; an adjustment mechanism for adjusting the position of the front ends of the pair of elongate stretching bars, both horizontally and vertically, with respect to the support frame; and an adjustment mechanism for adjusting the position of the rear ends of the pair of elongate stretching bars, both horizontally and vertically, with respect to the support frame.

A primary objective of the present invention is to provide a stretching device having advantages not taught by the prior art.

Another objective is to provide a stretching device that provides a superior support mechanism and guide for performing a wide range of stretching and exercise activities.

Another objective is to provide a stretching device that may be adjusted to provide elongate stretching bars that are at a selected height and angle for best performing the multiple stretching and exercise activities.

Another objective is to provide a stretching device that may be used to facilitate a broad range of stretching, exercising positions, and related activities and treatments, such as yoga; rehabilitation, exercises, and related activities.

Another objective is to provide a stretching device that may be used to normalize the myofascial, musculoskeletal, lymphatic, and/or nervous systems.

Another objective is to provide a stretching device that may be used to restore the natural three-dimensional relational balance of myofascial and muscular-skeletal systems at both micro and macro levels by releasing adhesions and increasing interstitial fluid and lymphatic flow.

A further objective is to provide a stretching device that is easy to use and comfortable for the person performing the stretching and exercise activities.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a stretching device 10 for assisting a person with stretching. For purposes of this application, the term "stretching" is defined to include a broad range of stretching, exercising positions, and related activities and treatments (e.g., yoga positions, various forms of rehabilitation movements, exercises, and positions, normalizing the myofascial and/or musculoskeletal system and/or lymphatic system and/or nervous system, etc., as well as a range of similar or related activities).

Figure 1:
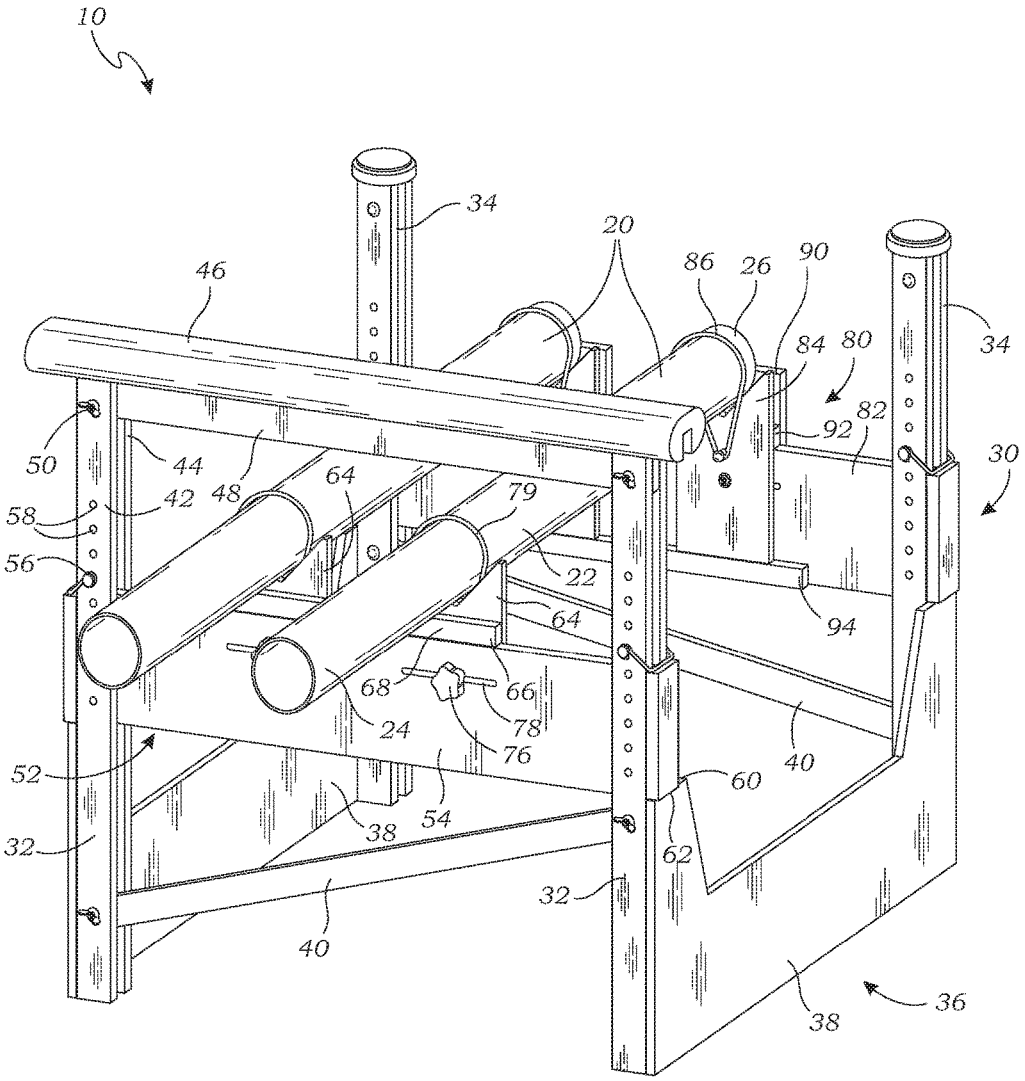
FIG. 1 is a perspective view of a stretching device according to one embodiment of the present invention.

FIG. 1 is a perspective view of a first embodiment of the stretching device 10. As shown in FIG. 1, the stretching device 10 comprises a pair of elongate stretching bars 20, a support frame 30, and an adjustment mechanism 52 for adjusting the positions of the ends of the elongate stretching bars 20, both horizontally and vertically, with respect to the support frame 30. This construction enables the stretching device 10 to be adjusted so that the elongate stretching bars 20 are positioned for performing a wide range of activities.

Figure 2:
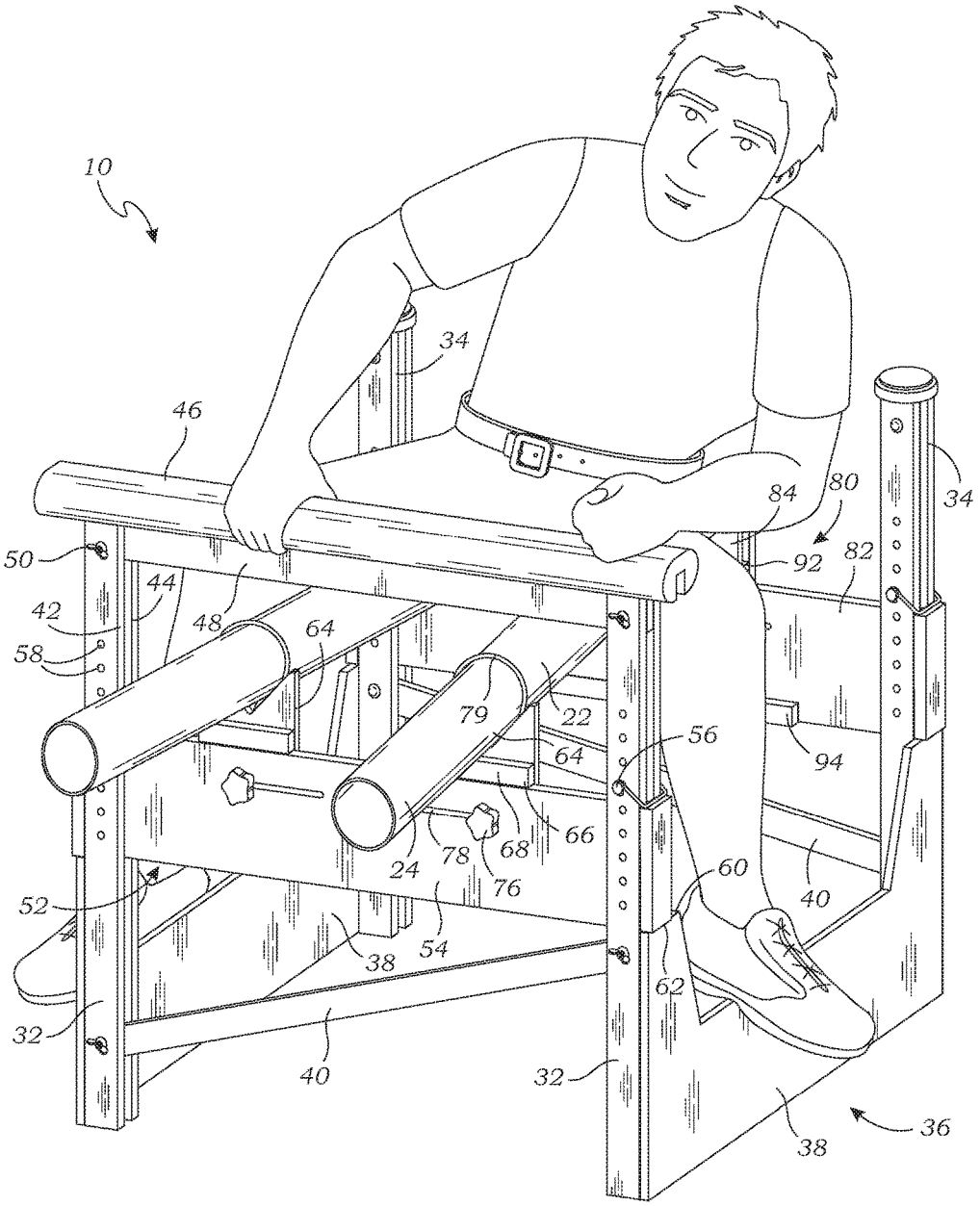
FIG. 2 is a perspective view thereof, illustrating a person performing a stretching exercise using the stretching device.

FIG. 2 is a perspective view of the stretching device 10 of FIG. 1, illustrating a person performing a stretching exercise using the stretching device 10. As shown in FIG. 2, the user is able to straddle the elongate stretching bars 20 so that the user's legs are stretched apart. The user is able to grasp and/or lean upon a front lateral rail 46 for greater comfort and stability. As discussed below, and as may be determined by one skilled in the art, a wide range of stretches and exercises may be performed using the device 10.

Figure 3:
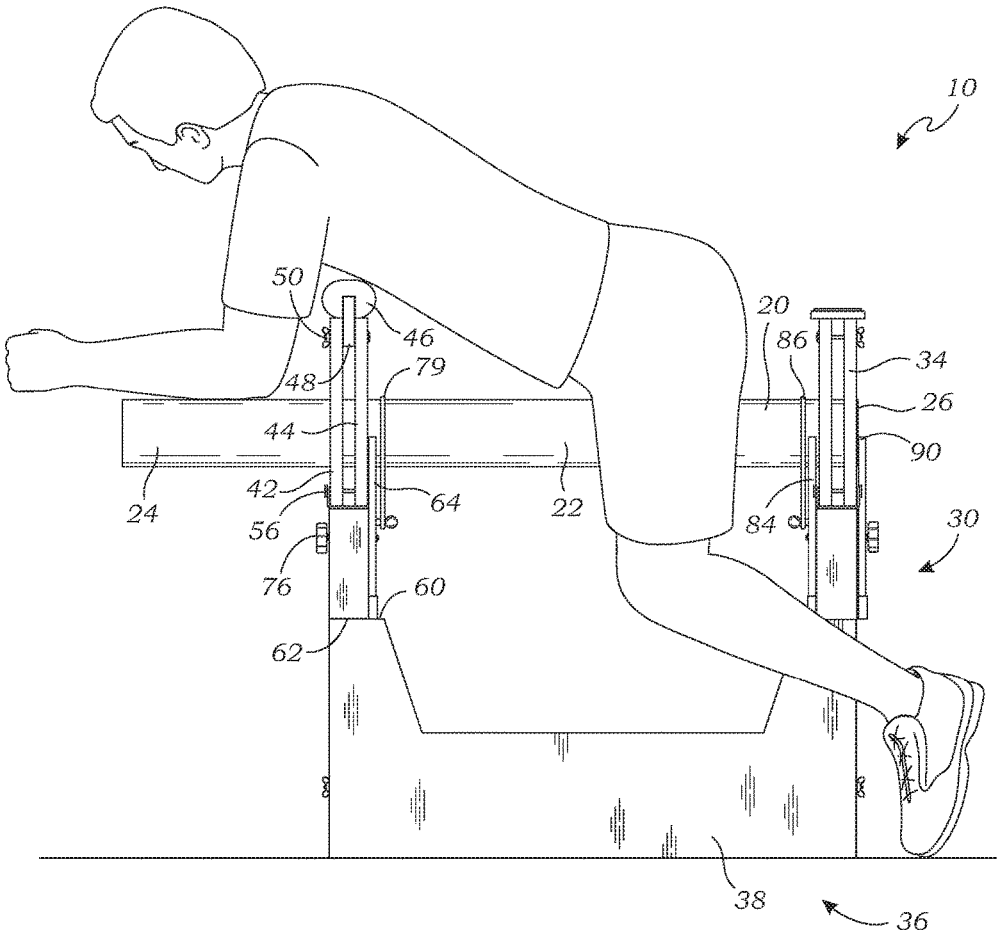
FIG. 3 is a side elevational view thereof, illustrating the person performing another stretching exercise.
Figure 4:
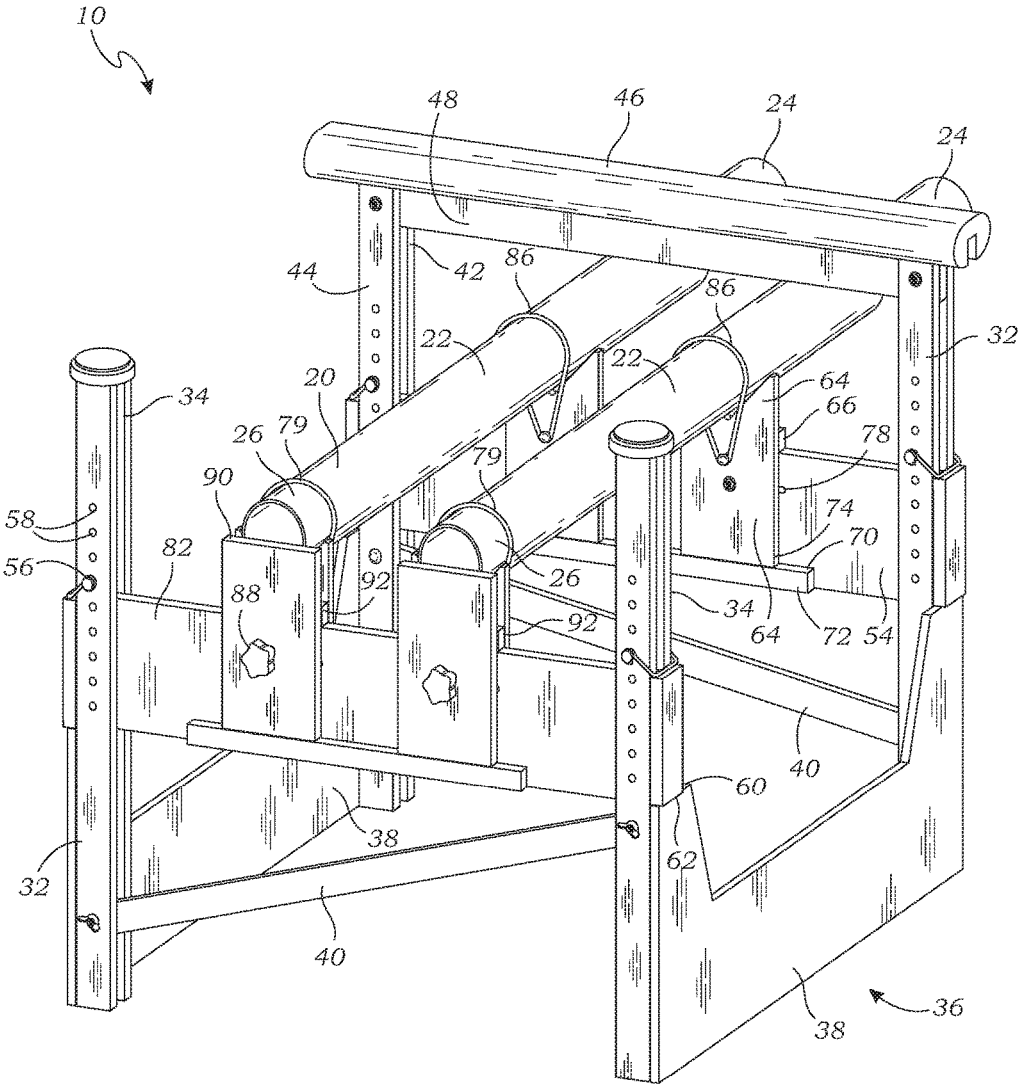
FIG. 4 is a rear perspective view of the stretching device.

FIG. 3 is a side elevational view of the stretching device 10, illustrating the person performing a similar stretching exercise on the stretching device 10. FIG. 4 is a rear perspective view of the stretching device 10.

As shown in FIGS. 1-4, the pair of elongate stretching bars 20 each have a main body 22 that extends from a front end 24 to a rear end 26. In the embodiment of FIGS. 1-4, the elongate stretching bars 20 are tubular in construction, in this case with a round cross section, although other cross sectional shapes may also be used in alternative embodiments. In this embodiment, the elongate stretching bars 20 are constructed of plastic, which provides a suitable level of hardness and rigidity; however, in alternative embodiments, it may be constructed of alternative materials that provide desirable characteristics (e.g., but not limited to, a hard foam, or other material deemed suitable by one skilled in the art).

In other embodiments, the elongate stretching bars 20 may be solid rods, or in other shapes that are comfortable for the user and suitable for use as described below. In another embodiment, the main body 22 may include a padded outer covering (shown in FIG. 6) for providing greater comfort to the person stretching on the device. While these embodiments illustrate some optional constructions of the present invention, those skilled in the art may devise alternative constructions that perform as described herein, and such alternatives should be considered within the scope of the present invention.

As shown in FIG. 1, the stretching device 10 includes a support frame 30 for supporting each of the elongate stretching bars 20 above the ground in a side-by-side orientation, that is suitable for stretching exercises, as discussed in greater detail below. In this embodiment, the support frame 30 includes a pair of front support posts 32, a pair of rear support posts 34, and a framework 36 connecting the front and rear support posts 32 and 34, so that the support posts 32 and 34 are supported in an upwardly extending orientation. In the embodiment of FIG. 1, the framework includes side panels 38 connecting each of the front support posts 32 to one of the rear support posts 34, and the framework 36 may further include lateral cross supports 40 (e.g., panels, rods, other forms of frame members, etc.). While one embodiment of this construction is illustrated, those skilled in the art may devise a great range of constructions that perform the required structural support. Examples may include, but are not limited to, single panels of suitable shape and size, any arrangement of posts, struts and similar structural supports, and similar alternative constructions known in the art. Such alternatives should be considered within the scope of the present invention.

In the embodiment of FIGS. 1-4, the front support posts 32 and the rear support posts 34 are each constructed of two pieces, a front post portion 42 and a rear post portion 44, which are parallel and spaced apart from each other. In this embodiment, a front lateral rail 46 extends across top ends of the pair of front support posts 32. A downwardly extending flange 48 extends from the front lateral rail 46 to between the front and rear support portions 42 and 44 of the pair of front support posts 32 and 34, and bolts 50 through the front support posts 32 and the downwardly extending flange 48 securely attach the front lateral rail 46 to the front support posts 32. The front lateral rail 46 not only provides structural strength to the framework 36, it also provides the user with a support structure for supporting himself/herself during the stretching exercises. In alternative embodiments, however, the front and rear support posts 32 and 34 may be of a single solid piece, or in other shapes that are suitable for the purposes described herein.

In the embodiment of FIGS. 1-4, the adjustment mechanism 52 is in the form of a means for adjusting the position of the front ends 24 of the pair of elongate stretching bars 20. In this embodiment, the means for adjusting the front ends may include a front lateral support 54 that is slidably mounted on the support frame 30 for sliding vertically for raising or lowering the front ends 24. In this embodiment, the front lateral support 54 is mounted between the front and rear post portions 42 and 44 of the front support posts 32, so that the front lateral support 54 may slide up and down therebetween for adjusting the height of the front lateral support 54, and thereby adjusting the height of the front ends 24 of the elongate stretching bars 20. A locking pin 56 may be positioned through one of a plurality of adjustment holes 58 through the front support posts 32 (and/or the front lateral support 54) for selectively locking the front lateral support 54 in a selected position.

While one embodiment of said means for adjusting is illustrated, those skilled in the art may devise alternative forms of adjusting, including various forms of movable mounts, pivots, and related structures known in the art for adjusting the position of the bars, and such alternatives, and equivalent structures, are considered within the scope of the present invention.

In the embodiment of FIGS. 1-4, a top edge 60 of the side panels 38 of the framework 36 may contact an under surface 62 of the front lateral support 54 for supporting the front lateral support 54 in a lowest position, as shown in FIG. 1, in which case the locking pin 56 is not used, and may be positioned through one of the adjustment holes 58 for storage. In alternative configurations, the front lateral support 54 may be supported in a raised position (as discussed below) by the locking pin 56 positioned beneath (or through) the front lateral support 54, as may be understood by one skilled in the art.

In the embodiment of FIGS. 1-4, the adjustment mechanism 52 for adjusting the front ends 24 further includes a pair of support brackets 64 that may be adjustably (e.g., slidably) mounted, or otherwise adjustably mounted, on the front lateral support 54, each supporting one of the elongate stretching bars 20. Each of the support brackets 64 may be adjusted laterally for adjusting the position of one of the front ends 24 of the elongate stretching bars 20. In this embodiment, a lower edge 66 of an upper rail 68 of each of the support brackets 64 rests upon and slides upon an upper edge 70 of the front lateral support 54. As shown in FIG. 4, a lower rail 72 of the front lateral support 54 similarly supports a lower edge 74 of the support brackets 64. A locking knob 76 may extend through both the support bracket 64 and an adjustment slot 78 of the front lateral support 54 so that the support bracket 64 may slide laterally, until the locking knob 76 is tightened or otherwise locked to prevent movement. In this manner, the support brackets 64 may be adjusted to a selected point and then locked in place to prevent movement during use.

In the embodiment of FIGS. 1-4, a strap 79 is attached to each of the support brackets 64 and extends over and around the elongate stretching bar 20 to secure the elongate stretching bar 20 to the support bracket. The strap 79 may be inelastic and tightly secured to prevent movement of the elongate stretching bar 20, or it may fit more loosely, and/or be somewhat elastic, to allow a certain degree of movement of the elongate stretching bar 20 with respect to the bracket.

In this embodiment, the stretching device 10 further includes an adjustment mechanism 80 for adjusting the position of the rear end 26 of the pair of elongate stretching bars 20, both horizontally and vertically, with respect to the support frame 30, although this may not be required in alternative embodiments. In the embodiment of FIGS. 1-4, the adjustment mechanism 80 for adjusting the position of the rear ends 26 includes a construction similar to the adjustment mechanism 52 for adjusting the position of the front end 24, namely, it includes a rear lateral support 82 that is slidably mounted on the support frame 30 for sliding vertically for raising or lowering the rear ends 26; and further includes a pair of support brackets 84 that are slidably mounted on the rear lateral support 82, each supporting one of the elongate stretching bars 20. Similar to the structures described above, each of the support brackets is mounted to slide horizontally for laterally adjusting the position of one of the rear ends 26, and a strap 86 may be attached to each of the support brackets and extending over the elongate stretching bar 20 to secure the elongate stretching bar 20 to the support bracket. A locking feature 88, such as locking knobs 76 discussed above, may also be included to lock the position of the support brackets 84.

As shown in FIGS. 1-4, the support brackets 84 that support the rear ends 26 of the elongate stretching bars 20 may each further include a stop plate 90 that extends upwardly behind the support bracket 84 for supporting one of the elongate stretching bars 20, so that the elongate stretching bar 20 does not slide off of the support bracket 84. The stop plate 90 may be disposed on a parallel plane to the support bracket, and spaced apart therefrom by a spacer 92. In this embodiment, the support bracket 84 and the stop plate 90 are disposed on opposite sides of the rear lateral support 82, such that the spacer 92 rests atop the rear lateral support 82. The stop plate 90 may rest atop a lower sliding rail 94 of the rear lateral support 82, for sliding thereupon.

As shown in FIG. 1, the support brackets 64 mounted on the front lateral support 54 are adjusted to a middle position so that the front ends 24 of the elongate stretching bars 20 are spaced apart from each other, and the elongate stretching bars 20 are in a generally side-by-side relationship and are generally parallel. FIG. 2 illustrates the support brackets 64 on the front lateral support 54 being adjusted to an outer position so that that elongate stretching bars 20 are angled outwardly with respect to each other (i.e., the front end 24*s* are further apart from one another than the rear end 26*s*). A person using the stretching device 10 is able to adjust this positioning according to his or her needs, to best facilitate his or her stretching or exercising requirements. Similarly, the support brackets on the rear lateral support 82 may similarly be adjusted.

Figure 5:
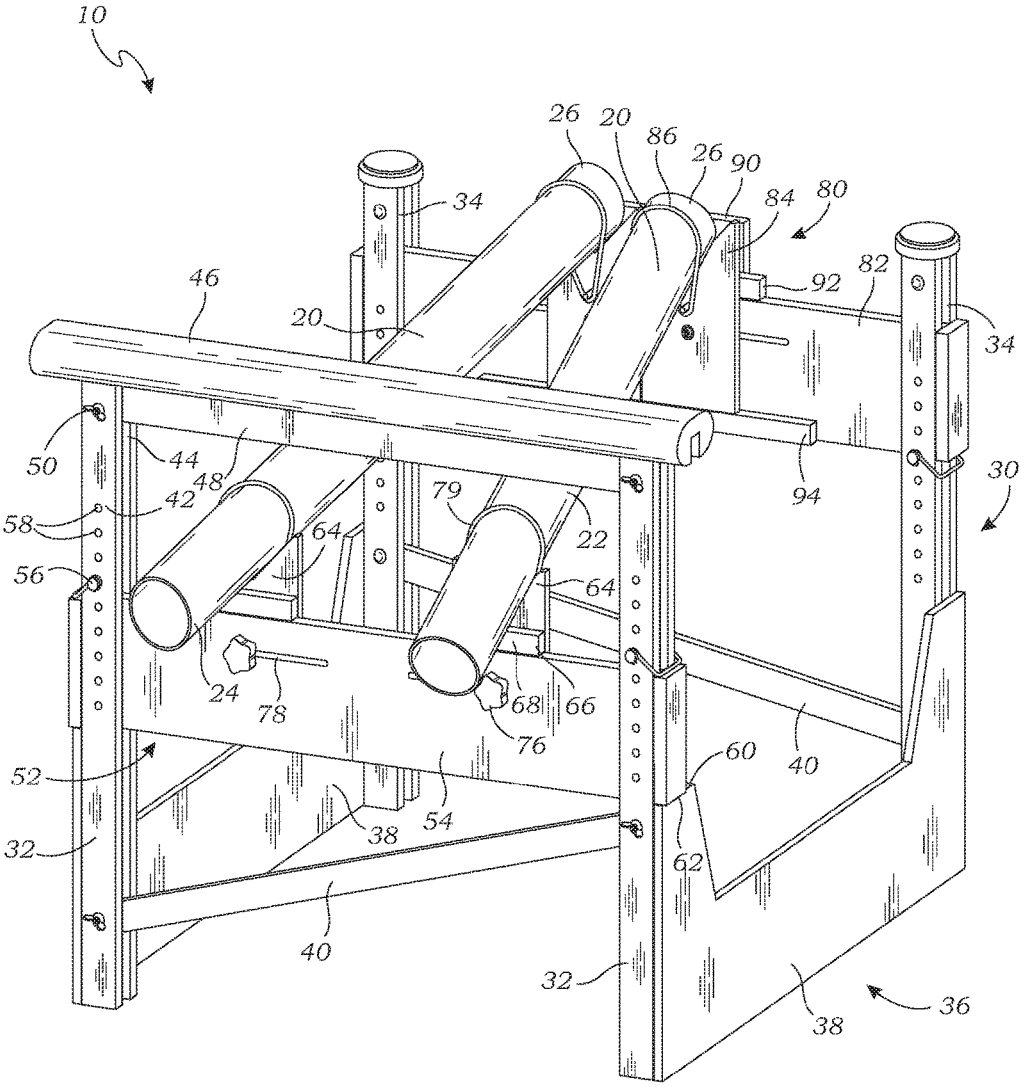
FIG. 5 is a perspective view of the stretching device of FIG. 1, illustrating the stretching device in another configuration.

FIG. 5 is a perspective view of the stretching device 10 of FIG. 1, illustrating the stretching device 10 in another configuration. In this configuration, the front lateral support 54 is in a lowered position, and the rear lateral support 82 in a raised position. Furthermore, the support brackets 64 on the front lateral support 54 are spaced apart from each other, while the support brackets 84 of the rear lateral support 82 are adjacent one another, so that the elongate stretching bars 20 are positioned at an angle with respect to one another. Obviously many configurations of the elongate stretching bars 20 are possible using the above described stretching device 10.

Figure 6:
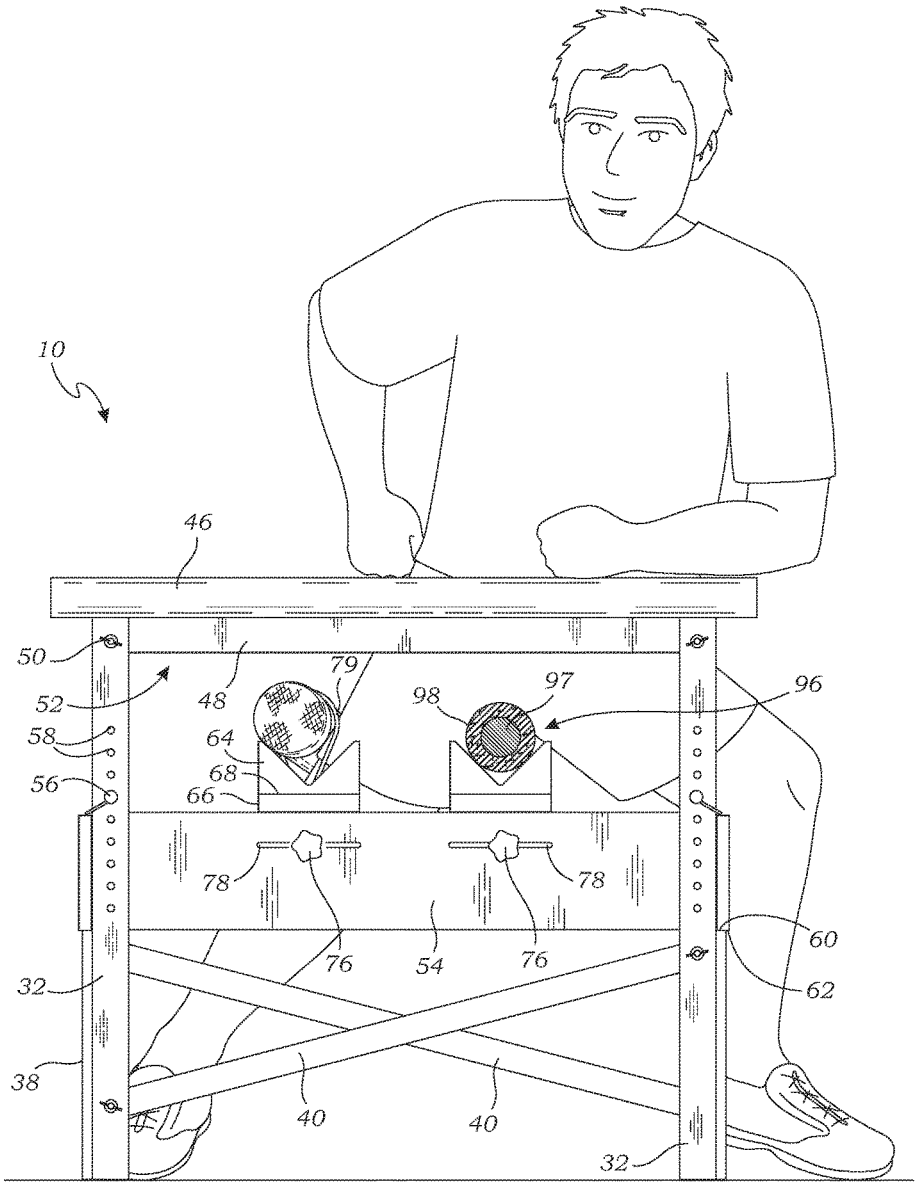
FIG. 6 is a front elevational view of the stretching device of FIG. 1, illustrating the person performing another form of stretching exercise, and also illustrating a second embodiment of the elongate stretching bars.

FIG. 6 is a front elevational view of the stretching device 10 of FIG. 1, illustrating the person performing another form of stretching exercise, wherein the person's leg is positioned between the elongate stretching bars 20. As shown in FIG. 6, in this embodiment, the stretching device 10 utilizes a second embodiment of the elongate stretching bars 20. FIG. 6 is shown with one of the ends of the elongate stretching bars 20 broken away to illustrate that, in this embodiment, each of the elongate stretching bars 20 includes a rigid inner core 97 (e.g., rod, tube, etc.) made of a rigid material such as plastic, metal, wood, or other suitable material. The rigid inner core 97 is covered by a padded exterior 98 (e.g., foam, fibers, cloth, etc.). While: these two embodiments are illustrated, those skilled in the art may devise multiple embodiments of the elongate stretching bars 20, and such alternative embodiments should be considered within the scope of the present invention.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by the following claims.

What is claimed is:

1. A stretching device comprising:

a pair of elongate stretching bars, each having a main body that extends from a front end to a rear end;

a support frame for supporting each of the elongate stretching bars above the ground in a side-by-side orientation; and an adjustment mechanism for adjusting the position of the front ends of the pair of elongate stretching bars, both horizontally and vertically, with respect to the support frame wherein the adjustment mechanism for adjusting the front ends includes a front lateral support that is slidably mounted on the support frame for sliding vertically for raising or lowering the front ends;

wherein the adjustment mechanism for adjusting the front ends further includes a pair of support brackets that are slidably mounted on the front lateral support, each supporting one of the elongate stretching bars, each of the support brackets sliding horizontally for laterally adjusting the position of one of the front ends; and further comprising a strap ached to each of the support brackets and extending over the elongate stretching bar to secure the elongate stretching bar to the support bracket.

2. The stretching device of claim 1, wherein the main body is tubular.

3. The stretching device of claim 1, wherein the main body includes a padded outer covering.

4. The stretching device of claim 1, further comprising an adjustment mechanism for adjusting the position of the rear ends of the pair of elongate stretching bars, both horizontally and vertically, with respect to the support frame.

5. The stretching device of claim 4, wherein e adjustment mechanism for adjusting the rear ends includes a rear lateral support that is slidably mounted on the support frame for sliding vertically for g or lowering the rear ends.

6. The stretching device of claim 5, wherein the adjustment mechanism for adjusting the rear ends further includes a pair of support brackets that are slidably mounted on the rear lateral support, each supporting one of the elongate stretching bars, each of the support brackets sliding horizontally for laterally adjusting the position of one of the rear ends.

7. The stretching device f claim 6, further comprising a strap attached to each of the support brackets and extending over the elongate stretching bar to secure the elongate stretching bar to the support bracket.

8. A stretching device comprising:

a pair of front support posts;

a pair of rear support posts;

a framework connecting the front and rear support posts so that the support posts are supported in an upwardly extending orientation, a front lateral support slidably mounted on h pair of front support posts so that the front lateral support slides vertically with respect to the pair of front support posts, and further comprising a pair of locking pins that each extends through one of the front support posts to lock the front lateral support in a selected position;

a rear lateral support connecting the pair of rear support posts;

a pair of elongate stretching bars each having a front end and a rear end, the front ends being operably supported by the front lateral support, and the rear ends being operably supported by the rear lateral support;

a pair of support brackets that are slidably mounted on the front lateral support, each supporting one of the elongate stretching bars, each of the support brackets being mounted on a track for sliding laterally for adjusting the position of one of the front ends; and a strap attached to each of the support brackets and extending over the elongate stretching bar to secure the elongate stretching bar to the support bracket.

9. The stretching device of claim 8, wherein the pair of elongate stretching bars each have a tubular construction.

* * * * *